US006706457B2

(12) United States Patent
Koumura

(10) Patent No.: US 6,706,457 B2
(45) Date of Patent: Mar. 16, 2004

(54) NON-MAGNETIC SINGLE-COMPONENT TONER AND DEVELOPING METHOD USING THE SAME

(75) Inventor: Mitsuhito Koumura, Shizuoka (JP)

(73) Assignee: Tomoegawa Paper Co., Ltd., Tokyo (JP)

( * ) Notice: Subject to any disclaimer, the term of this patent is extended or adjusted under 35 U.S.C. 154(b) by 0 days.

(21) Appl. No.: 09/986,953

(22) Filed: Nov. 13, 2001

(65) Prior Publication Data

US 2002/0086228 A1 Jul. 4, 2002

(30) Foreign Application Priority Data

Nov. 14, 2000 (JP) ..... P2000-346057

(51) Int. Cl.[7] ..... G03G 9/00
(52) U.S. Cl. ..... 430/108.3; 430/108.7
(58) Field of Search ..... 430/108.3, 108.7

(56) References Cited

U.S. PATENT DOCUMENTS

| | | | | |
|---|---|---|---|---|
| 5,486,420 A | | 1/1996 | Nishihara et al. | |
| 5,763,229 A | * | 6/1998 | Kobayashi et al. | 430/108.6 |
| 5,800,959 A | * | 9/1998 | Ikami | 430/126 |
| 5,914,210 A | | 6/1999 | Demizu et al. | |
| 6,117,607 A | | 9/2000 | Shimizu et al. | |
| 6,232,030 B1 | | 5/2001 | Otani et al. | |
| 6,503,677 B1 | | 1/2003 | Gutman et al. | |
| 2002/0086228 A1 | | 7/2002 | Koumura | |

FOREIGN PATENT DOCUMENTS

| | | |
|---|---|---|
| JP | 2-163760 | 6/1990 |
| JP | 2-300763 | 12/1990 |
| JP | 4-119361 | 4/1992 |
| JP | 4-152354 | 5/1992 |
| JP | 5-053369 | 3/1993 |
| JP | 5-346682 | 12/1993 |
| JP | 10-39534 | 2/1998 |
| JP | 11-202546 | 7/1999 |
| JP | 3091921 | 7/2000 |

* cited by examiner

*Primary Examiner*—Mark A. Chapman
(74) *Attorney, Agent, or Firm*—Nixon & Vanderhye P.C.

(57) ABSTRACT

A non-magnetic single-component toner comprises: silica A having a specific surface area of 30 to 70 $m^2/g$ as determined by a BET method, and having a surface which is at least treated with aminosilane, silica B having a specific surface area of 100 $m^2/g$ or more, and having a surface which is treated with silicone oil, silicone oil, and toner particles containing a binder resin and a colorant wherein silica A, silica B, silicon oil are adhered to surfaces of the toner particles, so that the toner that has suitable charging properties and anti-fusing and long life under all environmental atmosphere, and allows the obtaining of stable images having minimal back ground fogging, proper image density, no image density unevenness, and no voids in image (particularly on thick paper), and superior solid black reproducibility.

6 Claims, 1 Drawing Sheet

NON-MAGNETIC SINGLE-COMPONENT TONER AND DEVELOPING METHOD USING THE SAME

BACKGROUND OF THE INVENTION

1. Field of the Invention

The present invention relates to a non-magnetic single-component toner and developing method using the same, used for developing electrostatic latent images formed on a photosensitive member by electrophotography and the like.

2. Description of Related Art

Examples of conventional developing methods used for electrophotography and the like include a two-component developing method in which a magnetic brush is formed by charging an insulating powder having a binder resin for its main component, namely an insulating toner, and a magnetic carrier by friction, and an electrostatic latent image formed on a photosensitive member is developed with the magnetic brush; a magnetic single-component developing method in which an electrostatic latent image is developed with a single-component toner comprised of magnetic toner alone; and a non-magnetic single-component developing method in which a non-magnetic toner is formed in a thin layer on a developing sleeve and then an electrostatic latent image is developed by contact or non-contact of the thin layer with a photosensitive member.

Among each of the above developing methods, the non-magnetic single-component method in particular makes it possible to reduce the size of the developing assembly since it does not need to use together with a magnetic carrier, and in comparison with the magnetic single-component developing method, has superior toner transfer properties, fixing properties, and charging stability, thereby this method recently attracts considerable attention.

However, the non-magnetic single-component developing method caused the occurrence of fusing of toner to the developing sleeve (developing roller) composed of a non-magnetic sleeve and to the layer regulating member in the form of a charging blade during continuous copying of a large number of sheets. As a result, the problem occurred in which the thickness of the toner layer on the surface of the developing roller became non-uniform, causing the formation of white streaks and black streaks on the image. This trend created a particularly serious problem in the case of fine toner devised in response to requirements for high-resolution of recorded images.

As a means of solving such problems, attempts were made to impart fluidity to a conventional non-magnetic single-component toner by adhering an external additive composed of silica to toner particles having as their main components a binder resin such as styrene/acrylate copolymer, a colorant, and an charge control agent as described in Japanese Unexamined Patent Application, First Publication, No. 2-163760, Japanese Unexamined Patent Application, First Publication, No. 2-300763, and Japanese Unexamined Patent Application, First Publication, No. 4-152354.

However, even through such means were used, not only was the above toner fusing phenomenon unable to be completely eliminated, but since the charging property of the silica change considerably according to the environmental atmosphere, with charging properties increasing under low temperature and low humidity and conversely decreasing under high temperature and high humidity, there was the problem of significant impairment of toner charging stability.

BRIEF SUMMARY OF THE INVENTION

In light of the above problems of the conventional non-magnetic single-component toner and the developing method using the same, the object of the present invention is to provide a non-magnetic single-component toner and developing method using the same, that has suitable charging properties, anti-fusing properties and long life under all environmental atmosphere in non-magnetic single-component developing methods, and allows the obtaining of stable images having minimal background fogging, proper image density, no image density unevenness, and no voids in image (particularly on thick paper), and superior solid black reproducibility.

As a result of earnest studies to solve the above problems, the inventors of the present invention found in particular that a non-magnetic single-component toner in which silica A, the surface of which is treated with aminosilane, silica B, which is treated with silicone oil, and silicone oil are adhered is preferable, and created a developing method using this toner, in which development is performed by forming a thin layer of the non-magnetic single-component toner on the surface of a developing roller comprised of a non-magnetic sleeve.

Namely, the first aspect of the present invention is a non-magnetic single-component toner comprising: silica A having a specific surface area of 30 to 70 $m^2/g$ as determined by a BET method, and having a surface which is at least treated with aminosilane, silica B having a specific surface area of 100 $m^2/g$ or more, and having a surface which is treated with silicone oil, silicone oil, and toner particles containing a binder resin and a colorant wherein silica A, silica B, silicon oil are adhered to surfaces of the toner particles.

The second aspect of the present invention is the non-magnetic single-component toner according to the first aspect, wherein the surface of silica A is treated with aminosilane and hexamethyldisilazane.

The third aspect of the present invention is the non-magnetic single-component toner according to the first aspect, wherein the amount of silica A adhered to the toner particles is 0.1 to 0.5% by weight, and the amount of the silica B adhered to the toner particles is 0.3 to 2.0% by weight.

The fourth aspect of the present invention is the non-magnetic single-component toner according to the first aspect, wherein the ratio of silica A and the silica B is from 1:2 to 1:10.

The fifth aspect of the present invention is the non-magnetic single-component toner according to the first aspect, wherein the amount of the silicone oil adhered to the surface of the toner particles is 0.01 to 0.1% by weight.

In addition, the sixth aspect of the present invention is a developing method comprising: moving non-magnetic single-component toner to an electrostatic latent image of a photosensitive member installed adjacent to a non-magnetic sleeve and developing the electrostatic latent image by reversal development; wherein development is performed by forming a thin layer of the non-magnetic single-component toner according to the first aspect on the surface of the non-magnetic sleeve.

DETAILED DESCRIPTION OF THE INVENTION

Figure 1:
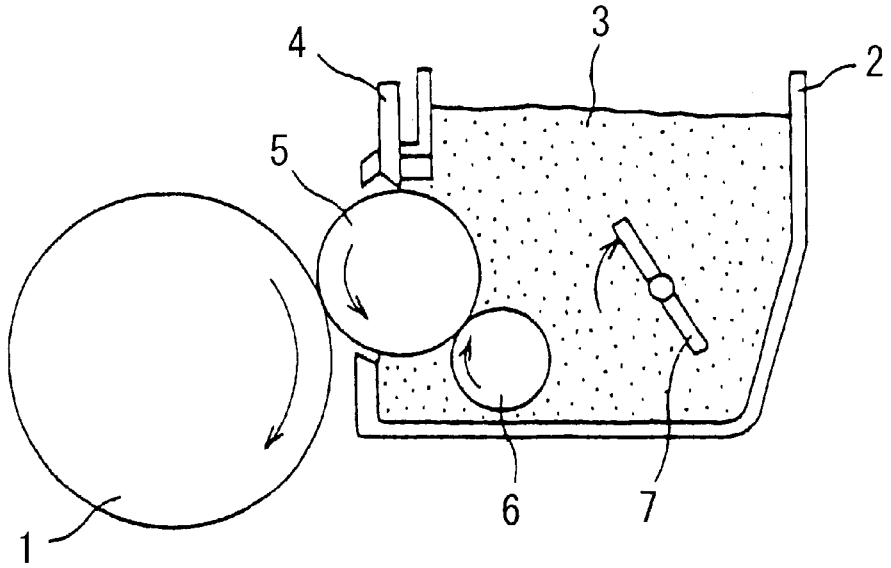
FIG. 1 is an explanatory drawing of a developing assembly used in the present invention.

The following provides a detailed explanation of the present invention.

The toner particles in the present invention are composed of at least a binder resin and colorant. Moreover, the toner particles may include anti-offset agent such as polypropylene and polyethylene, charge control agent, fluidity improving lubricant, and the like, and these are suitably mixed in a dispersed state. The toner particles are produced by melt-kneading-pulverizing method or by polymerization method, and have a volume average particle size within the range of 5 to 20 $\mu$m.

Examples of the above binder resin include homopolymers and copolymers of styrenes such as styrene, α-methylstyrene, and chlorostyrene; acrylates such as methyl acrylate, ethyl acrylate, propyl acrylate, butyl acrylate, octyl acrylate, and alkyl acrylates; methacrylates such as methyl methacrylate, ethyl methacrylate, propyl methacrylate, butyl methacrylate, octyl methacrylate, stearyl methacrylate, glycidyl methacrylate, and alkyl methacrylates; vinyl monomers such as acrylonitrile, maleic acid, maleate, vinyl chloride, vinyl acetate, vinyl benzoate, vinyl methyl ketone, vinyl hexyl ketone, vinyl methyl ether, vinyl ethyl ether and vinyl isobutyl ether, epoxy resins, polyester resins, polyurethane resins, and mixtures thereof.

Examples of colorants include carbon black, aniline blue, Calco oil blue, chrome yellow, ultramarine blue, Dupont oil red, quinoline yellow, methylene blue chloride, phthalocyanine blue, malachite green oxalate, lamp black, rose bengal, their mixtures, and the like. These colorants are required to be contained in an adequate ratio for the forming of visible images of adequate density, and at a ratio of about 1–20 parts by weight to 100 parts by weight of binder resin.

Examples of charge control agents that can be used alone or in combination include metal complex dyes, nigrosine dye, quaternary ammonium salts, triphenylmethane-based agents, and resin-based agents, and are used at a ratio of 0.1–5 parts by weight to 100 parts by weight of binder resin. Furthermore, in the present invention, it is necessary to determine the kind and blended amount of charge control agent so as to impart proper negative charging properties throughout the toner.

Silica A, which is adhered to the surface of the toner particles that compose the toner of the present invention, is required to have a specific surface area as determined by BET method of 30–70 $m^2/g$, and the surface of which must be treated at least with aminosilane.

Silica A controls the negative charging properties of silica B as a result of imparting positive charge properties due to aminosilane treatment, and has the effect of inhibiting increases of the amount of charge under low temperature and low humidity. In addition, in the case silica A has a specific surface area greater than 70 $m^2/g$, the fluidity of the toner becomes poor during continuous copying. Consequently, as the number of sheets of continuous copies increases, fusing of toner to the layer regulating member and non-magnetic sleeve occurs, thereby preventing the formation of a uniform toner layer on the non-magnetic sleeve and causing the formation of white streaks and black streaks on images. In addition, it becomes susceptible to fogging due to insufficient amount of charge. On the other hand, in the case the specific surface area as determined by BET method is less than 30 $m^2/g$, it becomes difficult for silica A to adhere to the toner particles, resulting in free occurring of silica. Accumulation of this free silica in the developer hopper results in the adherence of this silica to the non-magnetic sleeve and layer regulating member, thereby inhibiting toner charging and developing.

An aminosilane coupling agent is used for the above aminosilane, examples of which include γ-aminopropyltriethoxysilane, γ-aminopropylmethoxysilane, N-(β-aminoethyl)-γ-aminopropyltrimethoxysilane, γ-(2-aminoethyl)-γ-aminopropylmethyldimethoxysilane, γ-anilinopropyltrimethoxysilane, and the like.

Silica A is preferably used in combination with a hydrophobic treatment agent other than aminosilane in order to improve hydrophobic effects. Silica A is preferably used in combination with, for example, hexamethyldisilazane in particular because of its superior hydrophobic effects and ability to increase toner fluidity.

On the other hand, silica B is required to have a specific surface area as determined by BET method of 100 $m^2/g$ or more and its surface must be treated with silicone oil. Since silica B improves the transfer properties of the toner from the photosensitive member as well as anti-fusing to the layer regulating member as a result of the surface being treated with silicone oil, it improves the reproducibility of fine line images on thick paper (such as postcards) in particular. In the case the surface of silica B is not treated with silicone oil, as the number of copies increases, the reproducibility of fine line images particularly on thick paper (such as postcards) becomes remarkably poor and voids in image become significant.

The silicone oil of the surface treatment agent of silica B has a linear siloxane structure represented with $R_3SiO—[R_2SiO]_n—SiR_3$, specific examples of which are indicated below.

Examples of non-reactive silicone oil include dimethyl silicone oil, phenylmethyl silicone oil, chlorophenyl silicone oil, alkyl silicone oil, chlorosilicone oil, polyoxyalkylene denatured silicone oil, and fatty acid ester denatured silicone oil; examples of silicon functional silicone oils include methyl hydrogen silicone oil, silanol group-containing silicone oil, alkoxy group-containing silicone oil and acetoxy group-containing silicone oil; and examples of carbon functional silicone oils include amino denatured silicone oil, carboxylic acid denatured silicone oil, and alcohol denatured silicone oil.

In the case the specific surface area of silica B is less than 100 $m^2/g$, the fluidity of the toner particles becomes insufficient and the state in which toner is transported to the non-magnetic sleeve becomes bad, thereby making it difficult to form a uniform toner layer regardless of the number of copies. In particular, in the case of images having a large area of imaging part, such as solid black images, the image density become ragged in the latter half of printing, thereby the object of the present invention is prevented from being attained. On the other hand, if the specific surface area of silica B is excessively large, since practical problems occurs in terms of increased costs, the specific surface area of silica B is preferably 350 $m^2/g$ or less.

Furthermore, the specific surface area of silica as determined by BET method is measured using $N_2$ gas.

Silica A and silica B are preferably added at a ratio such that the amount of silica A adhered to the toner particles is 0.1 to 0.5% by weight relative to the toner particles, and the amount of silica B adhered to the toner particles is 0.3 to 2.0% by weight relative to the toner particles.

If the amount of silica A adhered is less than 0.1% by weight, toner fluidity becomes poor in the case of a large number of continuous copies, anti-fusing properties decreases, increased susceptibility to adherence to the non-magnetic sleeve is caused. In addition, the increase in the amount of toner charge during initial copying under low temperature and low humidity cannot be inhibited. On the other hand, if the adhered amount exceeds 0.5% by weight, the positive charge properties of silica A become excessively strong. Since this causes a decrease in the amount of negative charge of the toner overall, the problem occurs in which background fogging occurs at non-image parts.

On the other hand, if the amount of silica B adhered is less than 0.3% by weight, a uniform toner layer is unable to be formed on the non-magnetic sleeve due to insufficient toner fluidity and insufficient charging, and problems occur such as background fogging of non-image portions and poor solid black reproducibility during continuous copying. On the other hand, if the adhered amount exceeds 2.0% by weight, the effects of silica A are unable to be maintained, and the problem of a significant increase in the amount of negative charge of the toner under low temperature and low humidity is resulted in.

The ratio of silica A and silica B is preferably from 1:2 to 1:10. If the above ratio is less than 1:2 and the ratio of silica B is low, the effects of silica B are not manifested and the positive charge properties of silica A become excessively strong causing a reduction in the amount of negative charge of the overall toner, thereby background fogging of non-image parts increases. If the above ratio is greater than 1:10 and the ratio of silica B is high, the effects of silica A are inhibited and the negative charge properties of silica B under low temperature and low humidity increase significantly resulting in an accompanying increase in the amount of negative charge of the overall toner and an excess amount of negative charge, thereby problems such as filming, ghosts, and image memory on the photosensitive member are caused.

Although it has been previously stated that the transfer of toner from the photosensitive member and anti-fusing to the layer regulating member are improved by treatment of silica B with silicone oil, since this alone is not sufficient, it is also necessary to adhere silicone oil to the toner particles. The amount of silicone oil added is preferably 0.01 to 0.1% by weight. If the added amount is less than 0.01% by weight, there is no improvement of toner transfer from the photosensitive member observed and it becomes difficult to manifest anti-fusing also. On the other hand, if the amount added exceeds 0.1% by weight, toner fluidity worsens and ragged image density tends to occur on images having large printed parts such as solid black images. Examples of silicone oil previously described are used for the silicone oil in this case, and dimethyl silicone oil is preferable. The viscosity of the silicone oil is preferably about 50 CS at 25° C. in consideration of workability.

Examples of methods for adhering silica A, silica B and silicone oil to toner particles include methods using typical mixing devices such as turbine mixers, Henschel mixers, and super mixers, and methods using devices referred to as surface modifiers (such as the NARA HYBRIDIZATION SYSTEM made by Nara Machinery Co., Ltd. or the ONG-MILL made by Hosokawa Micron Corporation), in which, for example, predetermined amounts of toner particles, silica A and silicone oil are blended followed by mixing of silica B, the surface of which has been treated with silicone oil, using the same device. In addition, the silica on the surface of the toner particles may be set in a weakly adhered state on the toner particles, or the silica may be set and fixed in an adhered state in which a portion of the silica is embedded in the toner particles.

Next, a developing method of silica particles of the present invention will be explained. The developing assembly has a non-magnetic sleeve having a rubber or metal surface that is loaded with and transports non-magnetic single-component toner, and a layer regulating member having a rubber or metal surface provided either in close proximity to or pressed against the non-magnetic sleeve, supplies the non-magnetic single-component toner described above to the non-magnetic sleeve, forms a toner thin layer while imparting an electrical charge by the layer regulating member, causes the non-magnetic sleeve to make contact with a photosensitive member that holds an electrostatic latent image, develops the electrostatic latent image, and finally transfers that image to paper.

The following provides an explanation of the above method with reference to FIG. 1.

FIG. 1 is a schematic block diagram of a developing assembly used for a developing method of a non-magnetic single-component toner of contact developing of the present invention. In the drawing, reference symbol 1 indicates a photosensitive drum in the form of a cylindrical holder of electrostatic latent images, reference symbol 2 a hopper, reference symbol 3 non-magnetic single-component toner, reference symbol 4 a layer regulating member such as a doctor blade, reference symbol 5 a non-magnetic sleeve which covers a developing roller, reference symbol 6 a toner supply roller and reference symbol 7 a mixer. In this developing assembly, an electrostatic latent image is formed by electrophotography on the surface of photosensitive drum 1. Non-magnetic single-component toner 3 is housed in hopper 2. The toner layer formed on the surface of non-magnetic sleeve 5 by layer regulating member 4 is controlled to a constant layer thickness and a triboelectrical charge is imparted to the toner. Toner loaded onto the surface of non-magnetic sleeve 5 is contacted to the surface of photosensitive drum 1. At that time, the non-magnetic single-component toner is charged by friction by layer regulating member 4. In this case, the layer regulating member may be connected to a direct current or alternating current power supply, and an electric field may be generated between non-magnetic sleeve 5 and layer regulating member 4. Non-magnetic single-component toner loaded onto the surface of non-magnetic sleeve 5 is transported by rotation of non-magnetic sleeve 5 and makes contact with photosensitive drum 1 having an electrostatic latent image to develop the electrostatic latent image. Subsequently, the developed non-magnetic single-component toner on the surface of photosensitive drum 1 is transferred to paper or other transfer material. Furthermore, although photosensitive drum 1 shown in FIG. 1 is cylindrical, it may also be in the form of an elastic belt.

Furthermore, the present invention is not limited to a contact type of reversal developing system, but can be applied to a normal transfer developing system provided a positive polarity photosensitive member.

EXAMPLES

Although the following provides a more detailed explanation of the present invention based on its examples, the present invention is not limited to these examples. Furthermore, parts refer to parts by weight in the examples.

Example 1

[Production of Toner Particles]

| | |
|---|---|
| Polyester resin (Mitsui Chemicals, Inc., trade name: XPE-2198) | 90 parts |
| Low molecular weight polypropylene wax (Sanyo Chemical Industries, Ltd., trade name: Viscoll 550P) | 2 parts |
| Carbon black (Cabot Corporation, trade name: Regal 330R) | 7 parts |

-continued

| | |
|---|---|
| Metal complex dye (Hodogaya Chemical Co., Ltd., trade name: T4-48) | 1 part |

Raw material composed in the above mixing ratios was mixed with a super mixer and after hot-melt kneading with a biaxial kneader, the mixture was pulverized with a jet mill followed by classifying with a dry air classifier to obtain toner particles having a volume average particle size (as measured with a Coulter counter) of 10 $\mu$m.

[Production of Toner]

Hydrophilic silica (Nippon Aerosil Co., Ltd., No. 500) having a BET specific surface area of 50 $m^2/g$ was treated with a 1:1 mixture of γ-aminopropyltriethoxysilane and hexamethyldisilazane to obtain positively charged silica A.

Hydrophilic silica (Nippon Aerosil Co., Ltd., No. 200) having a BET specific surface area of 200 $m^2/g$ was treated with dimethylpolysiloxane to obtain negatively charged silica B.

0.1% by weight silica A, 0.3% by weight silica B, and 0.025% by weight dimethyl silicone oil (viscosity of 50 cs at 25° C.) were added to the above toner particles followed by stirring and mixing for 5 minutes with a Henschel mixer to obtain the non-magnetic single-component toner of the present invention.

Example 2

With the exception of changing the amount of silica A of Example 1 added to 0.3% by weight, changing the specific surface area of silica B to 130 $m^2/g$ (Nippon Aerosil Co., Ltd., No. 130), changing the amount of silica B added to 1.5% by weight and changing the amount of dimethyl silicone oil added to 0.50% by weight, the non-magnetic single-component toner of the present invention was obtained in the same manner as Example 1.

Comparative Example 1

With the exception of changing the specific surface area of silica A of Example 1 to 200 $m^2/g$, a non-magnetic single-component toner was obtained for the sake of comparison in the same manner as Example 1.

Comparative Example 2

With the exception of changing the specific surface area of silica B of Example 1 to 50 $m^2/g$, a non-magnetic single-component toner was obtained for the sake of comparison in the same manner as Example 1.

Comparative Example 3

With the exception of not using silica A of Example 1, a non-magnetic single-component toner was obtained for the sake of comparison in the same manner as Example 1.

Comparative Example 4

With the exception of not using silica B of Example 1, a non-magnetic single-component toner was obtained for the sake of comparison in the same manner as Example 1.

Comparative Example 5

With the exception of not using dimethyl silicone oil added to the toner particles of Example 1, a non-magnetic single-component toner was obtained for the sake of comparison in the same manner as Example 1.

Comparative Example 6

With the exception of treating silica A of Example 1 with hexamethyldisilazane only, a non-magnetic single-component toner was obtained for the sake of comparison in the same manner as Example 1.

Comparative Example 7

With the exception of treating the silica B of Example 1 with dimethyldichlorosilane, which is not equivalent to a silicone oil, instead of dimethylpolysiloxane, a non-magnetic single-component toner was obtained for the sake of comparison in the same manner as Example 1.

The toner characteristics (fluidity, adhered amount, amount of charge) of the non-magnetic single-component toners obtained in the embodiments and comparative examples, image characteristics (image density, background fogging, voids in image on postcard, solid black reproducibility) when printing out A4-sized paper in a lateral direction at the rate of 20 sheets/minute with a laser printer having a non-magnetic single-component developing assembly using a negative polarity organic photosensitive member (contact type reversal developing system), anti-fusing and anti-filming were evaluated. Evaluations were carried out at the start of copying and after making 5000 continuous copies.

The measurement and evaluation methods were as described below.

[Measurement Characteristics]

Figure 2:
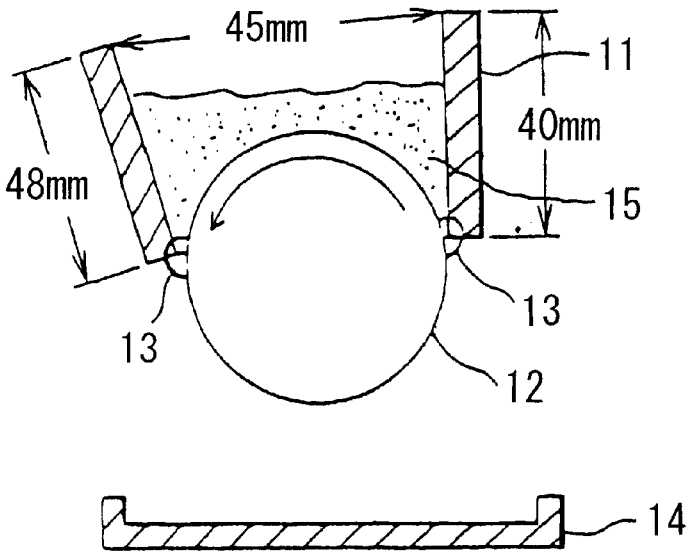
FIG. 2 is an explanatory drawing of a toner dropping amount tester in the present invention.

(1) Fluidity (g/5 minutes): The dropping amount tester shown in FIG. 2 was used. Namely, the tester is composed of hopper 11 containing toner sample 15 (height: 40 mm, upper opening width: 45 mm), roller 12 (20 mmϕ×132 mm) disposed at the bottom of the hopper 11 with leaving gap 13 (70 $\mu$m), and a toner receiving tray. The surface of the roller 12 is knurled and rotates in the direction of the arrow at a rotating speed of 3 rpm.

The measurement procedure consists of: (a) placing 20 g of toner sample 15 in hopper 11, (b) rotating roller 12 for 5 minutes to allow toner sample 15 to drop down, and (c) weighing the toner receiving tray containing toner sample and the toner receiving tray alone to calculate the difference of both as the dropping amount which is used as an indication of fluidity.

(2) Adhered amount ($g/cm^2$): Toner on the non-magnetic sleeve is aspirated with an aspirator equipped with a filter, and the weight of the toner accumulated on the filter is divided by the aspirated surface area of the sleeve.

(3) Amount of charge ($\mu c/g$): The electrodes of the TB-200 blow-off powder charge measuring instrument (Toshiba Chemical Corporation) were connected to the above non-magnetic sleeve, the amount of charge of the sleeve after aspirating the toner was measured, and the charge was divided by the aspirated amount and taken to have the opposite polarity.

[Image Characteristics]

(1) Image density: Image density was measured with the RD-914 Reflection Densitometer (Aretag MacBeth LLC.).

(2) Background fogging: The whiteness of a non-image part was measured with the ZE-2000 Color Meter (Nippon Denshoku Industries Co., Ltd.) and the difference between values before and after printing was determined.

(3) Voids in image on postcard: The presence of voids in image after printing two consecutive copies of a character pattern using postcard paper (Toyo Koeki, trade name: TPARK1002XC22) was evaluated visually. The absence of voids in image was indicated with an ○ and the presence of voids in image was indicated with an ×.

(4) Solid black reproducibility: The presence of ragged edge was evaluated visually after printing two consecutive solid black copies. The absence of ragged image density was indicated with an ○ and the presence of ragged image density was indicated with an ×.

[Anti-Fusing]

Fusing to the layer regulating member after 5000 copies was evaluated visually. The absence of fusing was indicated with an ○ and the presence of fusing was indicated with an ×.

[Anti-Filming]

Filming of toner on the surface of the photosensitive drum after 5000 copies was evaluated visually. The absence of filming was indicated with an ○ and the presence of filming was indicated with an ×.

The results of evaluating the above measured parameters in an atmosphere at 25° C. and 65% RH are shown in Table 1, the results of evaluating in an atmosphere at 10° C. and 20% RH are shown in Table 2, and the results of evaluating in an atmosphere at 30° C. and 80% RH are shown in Table 3. According to Tables 1 through 3, both initially and after 5000 copies, the non-magnetic single-component toner of the present invention exhibited image density of 1.35 or more, fogging of 0.61 or less, and the absence of voids in image on postcard, solid black ragged image density, fusing to the layer regulating member and filming on the surface of the photosensitive drum, demonstrating superior performance not found in the prior art. In contrast, Comparative Examples 1 through 7 all exhibited some form of shortcoming.

TABLE 1

| | Toner characteristics | | | Image characteristics | | | |
|---|---|---|---|---|---|---|---|
| | Fluidity g/5 min. | Amt. adhered mg/cm$^2$ | Amt. of charge −μc/g | Image density | Fogging | Voids in image on postcard | Solid black reproducibility |
| | | | | Initially | | | |
| Ex. 1 | 3.72 | 0.534 | 47.2 | 1.36 | 0.42 | ○ | ○ |
| Ex. 2 | 4.45 | 0.745 | 59.7 | 1.43 | 0.33 | ○ | ○ |
| C.E. 1 | 3.91 | 0.588 | 41.3 | 1.39 | 1.23 | ○ | ○ |
| C.E. 2 | 2.99 | 0.452 | 38.2 | 1.28 | 1.09 | ○ | X |
| C.E. 3 | 3.81 | 0.577 | 50.3 | 1.39 | 0.39 | ○ | ○ |
| C.E. 4 | 2.57 | 0.423 | 30.1 | 1.24 | 1.79 | X | X |
| C.E. 5 | 3.89 | 0.541 | 45.9 | 1.35 | 0.68 | ○ | ○ |
| C.E. 6 | 3.93 | 0.555 | 48.7 | 1.37 | 0.37 | ○ | ○ |
| C.E. 7 | 3.79 | 0.541 | 49.9 | 1.38 | 0.44 | ○ | ○ |
| | | | | After 5000 copies | | | |
| Ex. 1 | 3.61 | 0.601 | 40.0 | 1.38 | 0.56 | ○ | ○ |
| Ex. 2 | 4.21 | 0.689 | 51.3 | 1.41 | 0.41 | ○ | ○ |
| C.E. 1 | 3.22 | 0.501 | 27.9 | 1.28 | 1.41 | ○ | X |
| C.E. 2 | 2.81 | 0.478 | 25.2 | 1.24 | 1.78 | ○ | X |
| C.E. 3 | 3.04 | 0.498 | 28.7 | 1.28 | 1.31 | ○ | X |
| C.E. 4 | 2.49 | 0.469 | 22.9 | 1.20 | 1.98 | X | X |
| C.E. 5 | 3.77 | 0.579 | 37.9 | 1.36 | 0.87 | ○ | ○ |
| C.E. 6 | 3.82 | 0.599 | 42.5 | 1.38 | 0.78 | ○ | ○ |
| C.E. 7 | 3.71 | 0.621 | 39.2 | 1.40 | 0.65 | X | ○ |
| | | | | After 5000 copies | | | |

| | Anti-fusing | Anti-filming |
|---|---|---|
| Ex. 1 | ○ | ○ |
| Ex. 2 | ○ | ○ |
| C.E. 1 | X | ○ |
| C.E. 2 | ○ | ○ |
| C.E. 3 | X | ○ |
| C.E. 4 | ○ | ○ |
| C.E. 5 | X | ○ |
| C.E. 6 | ○ | ○ |
| C.E. 7 | ○ | ○ |

*25° C., 65% RH

TABLE 2

| | Toner characteristics | | | Image characteristics | | | |
|---|---|---|---|---|---|---|---|
| | Fluidity g/5 min. | Amt. adhered mg/cm$^2$ | Amt. of charge −μc/g | Image density | Fogging | Voids in image on postcard | Solid black reproducibility |
| | | | | Initially | | | |
| Ex. 1 | 3.81 | 0.631 | 51.2 | 1.38 | 0.44 | ○ | ○ |
| Ex. 2 | 4.47 | 0.757 | 62.0 | 1.44 | 0.40 | ○ | ○ |
| C.E. 1 | 3.99 | 0.621 | 48.8 | 1.42 | 0.99 | ○ | ○ |
| C.E. 2 | 3.03 | 0.463 | 40.3 | 1.31 | 1.22 | ○ | X |
| C.E. 3 | 3.88 | 0.612 | 53.4 | 1.40 | 0.52 | ○ | ○ |
| C.E. 4 | 2.60 | 0.401 | 31.3 | 1.27 | 2.21 | X | X |
| C.E. 5 | 3.92 | 0.541 | 47.1 | 1.33 | 0.77 | ○ | ○ |

TABLE 2-continued

| | | | | | | | |
|---|---|---|---|---|---|---|---|
| C.E. 6 | 3.99 | 0.889 | 58.8 | 1.46 | 1.87 | ○ | ○ |
| C.E. 7 | 3.83 | 0.557 | 53.3 | 1.40 | 0.55 | ○ | ○ |
| After 5000 copies | | | | | | | |
| Ex. 1 | 3.74 | 0.668 | 44.2 | 1.41 | 0.13 | ○ | ○ |
| Ex. 2 | 4.27 | 0.700 | 52.0 | 1.43 | 0.10 | ○ | ○ |
| C.E. 1 | 3.25 | 0.671 | 30.0 | 1.31 | 1.35 | ○ | X |
| C.E. 2 | 2.89 | 0.488 | 28.0 | 1.26 | 1.98 | ○ | X |
| C.E. 3 | 3.09 | 0.510 | 30.0 | 1.30 | 1.53 | ○ | X |
| C.E. 4 | 2.51 | 0.441 | 23.3 | 1.22 | 2.43 | X | X |
| C.E. 5 | 3.77 | 0.591 | 38.1 | 1.38 | 0.34 | X | ○ |
| C.E. 6 | 3.85 | 0.801 | 50.1 | 1.46 | 0.89 | ○ | ○ |
| C.E. 7 | 3.74 | 0.651 | 41.4 | 1.41 | 0.31 | X | ○ |
| After 5000 copies | | | | | | | |

| | Anti-fusing | Anti-filming |
|---|---|---|
| Ex. 1 | ○ | ○ |
| Ex. 2 | ○ | ○ |
| C.E. 1 | X | ○ |
| C.E. 2 | ○ | ○ |
| C.E. 3 | X | ○ |
| C.E. 4 | ○ | ○ |
| C.E. 5 | X | ○ |
| C.E. 6 | ○ | X |
| C.E. 7 | ○ | ○ |

*10° C., 20% RH

TABLE 3

| | Toner characteristics | | | Image characteristics | | | |
|---|---|---|---|---|---|---|---|
| | Fluidity g/5 min. | Amt. adhered mg/cm$^2$ | Amt. of charge $-\mu c/g$ | Image density | Fogging | Voids in image on postcard | Solid black reproducibility |
| Initially | | | | | | | |
| Ex. 1 | 3.69 | 0.541 | 45.0 | 1.35 | 0.48 | ○ | ○ |
| Ex. 2 | 4.38 | 0.699 | 58.1 | 1.41 | 0.37 | ○ | ○ |
| C.E. 1 | 3.87 | 0.541 | 36.6 | 1.35 | 1.33 | ○ | ○ |
| C.E. 2 | 2.79 | 0.476 | 36.4 | 1.25 | 1.77 | ○ | X |
| C.E. 3 | 3.77 | 0.535 | 48.5 | 1.37 | 0.41 | ○ | ○ |
| C.E. 4 | 2.41 | 0.399 | 31.2 | 1.25 | 1.99 | X | X |
| C.E. 5 | 3.81 | 0.539 | 42.9 | 1.33 | 0.71 | ○ | ○ |
| C.E. 6 | 3.87 | 0.535 | 46.9 | 1.36 | 0.41 | ○ | ○ |
| C.E. 7 | 3.77 | 0.539 | 48.7 | 1.37 | 0.61 | ○ | ○ |
| After 5000 copies | | | | | | | |
| Ex. 1 | 3.57 | 0.588 | 38.9 | 1.37 | 0.61 | ○ | ○ |
| Ex. 2 | 4.21 | 0.656 | 49.0 | 1.40 | 0.51 | ○ | ○ |
| C.E. 1 | 3.11 | 0.449 | 24.0 | 1.26 | 1.87 | ○ | X |
| C.E. 2 | 2.59 | 0.481 | 23.1 | 1.24 | 1.99 | ○ | X |
| C.E. 3 | 2.89 | 0.479 | 27.2 | 1.26 | 1.57 | ○ | X |
| C.E. 4 | 2.34 | 0.435 | 21.1 | 1.20 | 2.31 | X | X |
| C.E. 5 | 3.61 | 0.569 | 36.1 | 1.38 | 0.91 | X | ○ |
| C.E. 6 | 3.79 | 0.581 | 41.2 | 1.37 | 0.81 | ○ | ○ |
| C.E. 7 | 3.68 | 0.613 | 37.9 | 1.38 | 0.81 | X | ○ |
| After 5000 copies | | | | | | | |

| | Anti-fusing | Anti-filming |
|---|---|---|
| Ex. 1 | ○ | ○ |
| Ex. 2 | ○ | ○ |
| C.E. 1 | X | ○ |
| C.E. 2 | ○ | ○ |
| C.E. 3 | X | ○ |
| C.E. 4 | ○ | ○ |
| C.E. 5 | X | ○ |
| C.E. 6 | ○ | ○ |
| C.E. 7 | ○ | ○ |

*30° C., 80% RH

The non-magnetic single-component toner of the present invention demonstrates the effects in the case of applying to a non-magnetic single-component developing assembly of superior image density, little background fogging, absence of voids in image (particular on thick paper), superior solid black reproducibility as well as superior anti-fusing and anti-filming under all environmental conditions.

What is claimed is:

1. A non-magnetic single-component toner comprising: silica A having a specific surface area of 30 to 70 $m^2/g$ as determined by a BET method, and having a surface which is at least treated with aminosilane, silica B having a specific surface area of 100 $m^2/g$ or more, and having a surface which is treated with silicone oil, silicone oil, and toner particles containing a binder resin and a colorant wherein silica A, silica B, silicone oil are adhered to surfaces of the toner particles.

2. The non-magnetic single-component toner according to claim 1, wherein the surface of silica A is treated with aminosilane and hexamethyldisilazane.

3. The non-magnetic single-component toner according to claim 1, wherein an amount of silica A adhered to the toner particles is 0.1 to 0.5% by weight, and an amount of the silica B adhered to the toner particles is 0.3 to 2.0% by weight.

4. The non-magnetic single-component toner according to claim 1, wherein a ratio of silica A and the silica B is from 1:2 to 1:10.

5. The non-magnetic single-component toner according to claim 1, wherein an amount of the silicone oil adhered to the surfaces of the toner particles is 0.01 to 0.1% by weight.

6. A developing method comprising: moving of non-magnetic single-component toner to an electrostatic latent image of a photosensitive member installed adjacent to a non-magnetic sleeve and developing by reversal development; wherein development is performed by forming a thin layer of the non-magnetic single-component toner according to claim 1 on a surface of a non-magnetic sleeve.

* * * * *